United States Patent [19]

Anderson

[11] Patent Number: 4,458,740

[45] Date of Patent: Jul. 10, 1984

[54] VENETIAN BLIND HANGER PIVOT ASSEMBLY

[75] Inventor: Richard N. Anderson, Owensboro, Ky.

[73] Assignee: Hunter Douglas, Inc., Totowa, N.J.

[21] Appl. No.: 387,035

[22] Filed: Jun. 10, 1982

Related U.S. Application Data

[63] Continuation-in-part of Ser. No. 332,809, Dec. 21, 1981.

[51] Int. Cl.[3] ..... E06B 9/38

[52] U.S. Cl. ..... 160/174; 160/107

[58] Field of Search ..... 160/166–178, 160/107

[56] References Cited

U.S. PATENT DOCUMENTS 1,022,415 4/1912 Hannam .
2,497,824 7/1945 Reed .
3,389,737 6/1968 Arnold et al. .
3,719,221 3/1973 Hanson .

FOREIGN PATENT DOCUMENTS 263181 11/1964 Australia .
2095958 11/1972 France .

*Primary Examiner*—Peter M. Caun
*Attorney, Agent, or Firm*—Pennie & Edmonds

[57] ABSTRACT

A venetian blind hanger pivot member for a venetian blind assembly having a plurality of slats including an upper end slat and a lower end slat and tape cables forming part of a slat suspension means. The hanger pivot member has a slat engaging surface engaging an end slat and a bearing portion which is pivotally engaged by suspension means in turn connected to a frame opening. The tape cables are connected to the hanger pivot member so as to extend over the edges of an end slat whereby when a hanger pivot member is pivoted about the suspension means, all of said slats are tilted.

19 Claims, 20 Drawing Figures

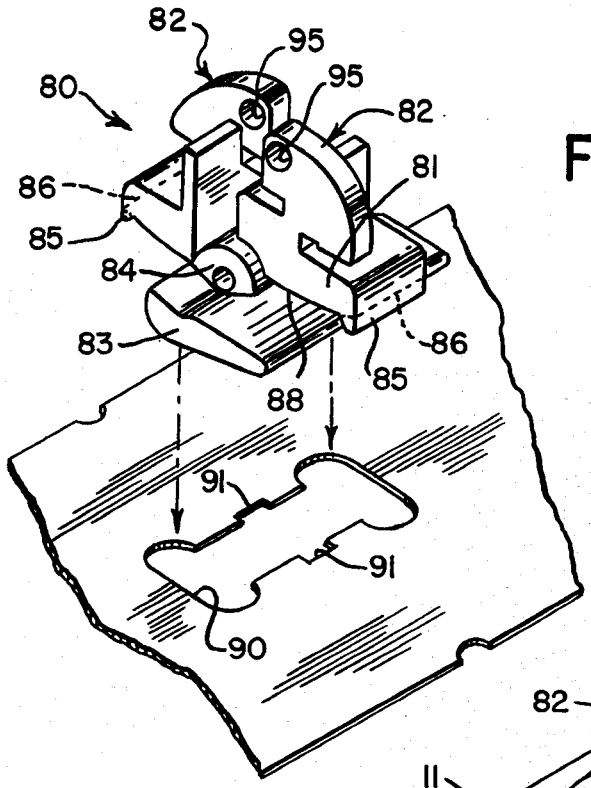
FIG. 8
FIG. 9
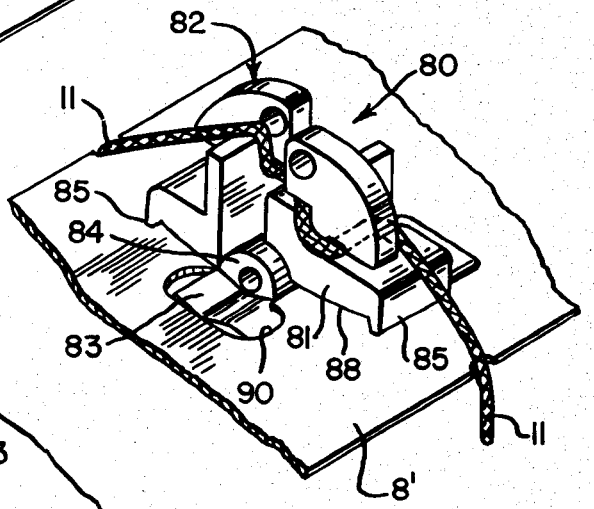
FIG. 10
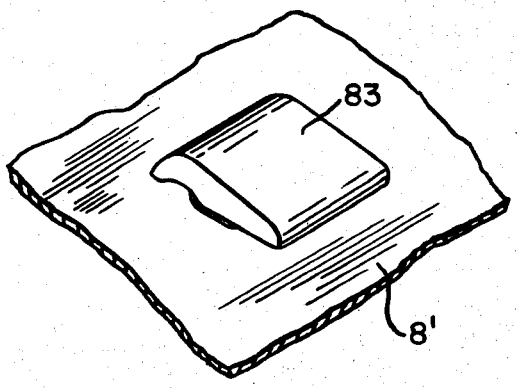

VENETIAN BLIND HANGER PIVOT ASSEMBLY

CROSS-REFERENCE TO OTHER APPLICATIONS

This application is a continuation-in-part of my copending application Ser. No. 332,809, filed Dec. 21, 1981.

TECHNICAL FIELD

This invention relates to a venetian blind hanger pivot member for supporting a venetian blind assembly and a suspension means for pivotally supporting the hanger pivot member.

BACKGROUND OF THE INVENTION

Venetian blind assemblies are conventionally suspended in a window or other frame opening from a complex headrail assembly which contains tilting and lifting hardware. Where greater stability for the blind assembly is required and/or where the blind assembly is not required to be raised or lowered, it may alternatively be suspended within the opening between special heavy top and bottom rails or slats. Such rails are pivotally mounted in the frame opening and the suspension for slats intermediate the rails is secured to the rails. These headrail assemblies and special top and bottom rails are much more expensive than the balance of the blind assembly. Further, since the headrail assemblies and top and bottom rails or slats comprise different components than the rest of the blind assembly, they necessarily complicate and increase the cost of inventory. The use of special top and bottom rails or slats results in a non-uniform coverage of the frame openings and gaps appearing at the suspension edges of the blind assembly.

Since color matching is a very important consideration from an aesthetic viewpoint, it is necessary that the components comprising the headrail assemblies and special top and bottom rails be color matched with the intermediate slats making up the major portion of the blind assembly. This further adds to the cost and complexity of inventory and of the complete blind assembly.

A further disadvantage of conventional blind assemblies is that closure of the assembly is often non-uniform from top to bottom. This is particularly true where the bottom rail or slat is not fixed in a manner to tension the suspension means supporting the intermediate slats.

Most conventional blind assemblies tend to remain in a particular tilt position of the slats after a force has been applied to change the tilt angle of the slats. In some instances, it is desirable to have a venetian blind assembly which will automatically return to either a slat open or slat closed position after a tilt changing force has been removed from a tilt control mechanism.

It is therefore an object of my invention to eliminate need for separate heavy top and bottom rails or slats in a venetian blind assembly and at the same time eliminate need for separate headrail assemblies and the hardware necessary to pivot the heavy slats with respect to the headrails.

It is a further object of the invention to provide a means for suspending a venetian blind assembly in an opening such that there can be a complete closure of the opening without any unusually large daylight cracks appearing at either the top or bottom of the blind assembly.

It is a further object of the invention to provide a venetian blind hanger pivot member supporting a suspension blind assembly which may be tilted with a minimum of effort about a suspension means.

A further object of the invention is to provide for a venetian blind assembly which may automatically return to either a slat open or slat closed position upon removal of a tilting force from a tilt mechanism.

DESCRIPTION OF THE INVENTION

Broadly a venetian blind hanger pivot member constructed according to my invention is for use with a venetian blind assembly having a plurality of slats including upper and lower end slats and tape cables forming part of a slat supporting means. The pivot member includes a body member having a slat engaging surface adapted to engage one side of a slat. Coupling means are included for holding the hanger pivot member and the end slat in a predetermined mutual position. The pivot body member has a pivot bearing portion adapted to be pivotally engaged by a suspension means attached to part of a frame opening. The tape cable means are secured to the body member by a tape cable securing means to extend over the side of the end slat to which the body member is engaged.

The hanger pivot member in a preferred form of the invention has a portion extending partially through the end slat with which it engages so that the pivot axis of the bearing portion is at a center of the slat.

In addition the hanger pivot member preferably has an extended portion extending away from the slat engaging surface with the extended portion including the tape cable securing means. In some forms of the invention, particularly where heavy tilt forces are required, the extended portion may also include a separate tilt drive cable securing means by which a tilt drive cable may be secured thereto in order to provide the tilt force necessary to tilt the hanger pivot member about the suspension bracket.

The coupling means holding the hanger pivot member to an end slat may comprise male connection members or tabs depending from the slat engaging surface which engage female connection members or openings in the end slat or notches on the edges of the end slats.

The hanger pivot member further preferably includes a fastening means associated with these coupling means by which the pivot member is fastened to the end slat. This fastening means may take a number of different forms. One form is to have a portion of the pivot member extend through an opening in the slat or over the edges of the slat such that it engages and clamps with the side of the slat opposite the side engaged by the slat engaging surface of the hanger pivot member. This portion may be forced over the edges or through the opening so as to snap against the opposite side or may be post formed by heat or pressure so as to engage the opposite side. In addition the hanger pivot member may be fastened by means of an adhesive to an end slat. The fastening means may also comprise clamping the hanger pivot member between tape cables on one side of an end slat and a rung extending between the tape cables on the other side of the end slat.

The hanger pivot member of the invention is adapted to engage flat slats, convex or concave curved slats or even slats having complex surfaces. Where the slat has a particular surface, the slat engaging surface of the hanger pivot member is complementary in shape.

In a further form of the invention the hanger pivot member has a slat engaging surface including breakoff tabs adapted to engage a convex side of an end slat and the hanger pivot member includes a flange connected to a pivot bearing portion adapted to engaged the opposite side of an end slat than the slat engaging surface. The end slat in this configuration has a cutout through which the flange may be inserted in order that it may snap onto the slat so as to secure the slat between the flange and the breakoff tabs. In this construction the bottom end slat of the blind assembly is preferably inverted with the result that a hanger pivot member of the same configuration may be used with both the top and bottom end slats.

In the event that for aesthetic reasons the bottom slat of the venetian blind assembly should not be inverted, then the breakoff tabs are removed leaving a convex slat engaging surface which then can engage the concave side of the bottom end slat.

In a still further form of the invention, the hanger pivot member may be in the general form of a cross with the top and bottom sides of the horizontal bar thereof being curved to form slat engaging surfaces adapted to engage either convex or concave sides of a slat. The vertical legs of the cross are identical and include longitudinally and laterally extending slots with a longitudinally extending slot over one side of the horizontal bar being adapted to receive a suspension means about which the pivot member may pivot and the laterally and longitudinally extending slots on the other side of the horizontal bar being adapted to receive tape cables to form part of a tape cable receiving means. The hanger pivot member has a coupling means comprising male member adapted to fit into female openings in a slat to hold the pivot member and slat in a predetermined position. This form of the invention is easily assembled with an end slat and may without further change be applied either to the convex or concave side of a curved end slat.

The suspension means used with the various forms of the hanger pivot member preferably comprises a wire bracket having arms with inturned ends adapted to engage into the pivot bearing portion. The wire bracket includes a base extending perpendicularly to the arms by which the suspension means may be connected directly by way of a clamp to the frame of an opening thus eliminating need of any separate headrail or associated hardware for mounting end slats into the headrail.

A hanger pivot member of the invention is particularly adaptable for use in a venetian blind assembly comprising a minimum of components. All that is required is a plurality of slats including an upper end slat and a lower end slat which is substantially of the same size and shape as the remainder of the slats, hanger pivot members, suspension brackets and slat supporting means including tape cables. Pivotal movement of the bearing member in such a construction about the suspension bracket results in tilting movement of all the slats including upper and lower end slats.

In the event that a blind assembly as just described is desired which will tend to automatically open upon removal of any tilting force, all that is required is to install the hanger members with respect to the end slats, so that as to the upper end slat, the pivot axis of the hanger pivot member engaging the slat is located above the center of the slat and, that as to the lower end slat, the pivot axis of the hanger pivot member engaging the slat is located below the center of the slat.

In those cases where it is desired that the blind assembly tend to automatically close upon removal of a tilting force, the arrangement of the pivot axes of the hanger pivot members with respect to the end slats is opposite from that for opening the slats. That is, the pivot axis of the hanger pivot portion engaging the upper end slat is positioned beneath the center of the slat while that of the hanger pivot portion engaging the lower end slat is positioned above the center of the slat.

BRIEF DESCRIPTION OF THE DRAWINGS

FIG. 8 is a perspective view of a further form of a hanger pivot member before application to a slat;

FIG. 9 is a view similar to FIG. 8 of the hanger pivot member mounted to a slat and illustrating partial threading of a tape cable to the hanger pivot member;

FIG. 10 is a view of the bottom side of the slat of FIG. 8 illustrating engagement with a hanger pivot member;

DESCRIPTION OF THE PREFERRED MODES

Figure 1:
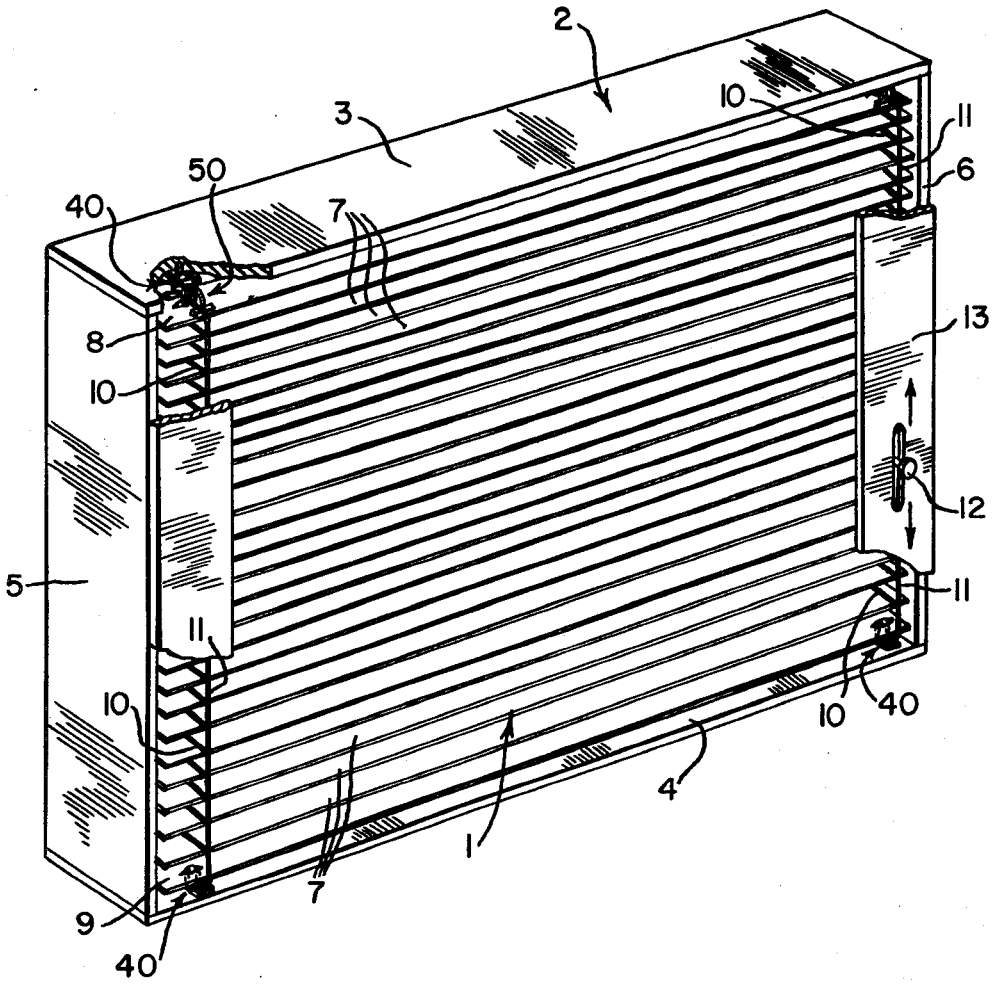
FIG. 1 is a perspective view of a venetian blind assembly installed as a window unit with which a hanger pivot member according to the invention is used.

Referring to FIG. 1, there is illustrated a venetian blind assembly 1 mounted within a window frame 2 having an upper frame member 3, a lower frame member 4 and side frame members 5 and 6. The venetian blind assembly includes a plurality of slats 7 including an upper end slat 8 and a bottom end slat 9. Two tape ladders 10 having tape cables 11 extend between the upper slat 8 and lower slat 9 and provide a support for the slats 7. A tilt adjustment knob 12 is mounted for linear movement in a front frame piece 13 and is connected to a tape cable 11 in order that the slats may be tilted between open and closed positions.

Figure 2:
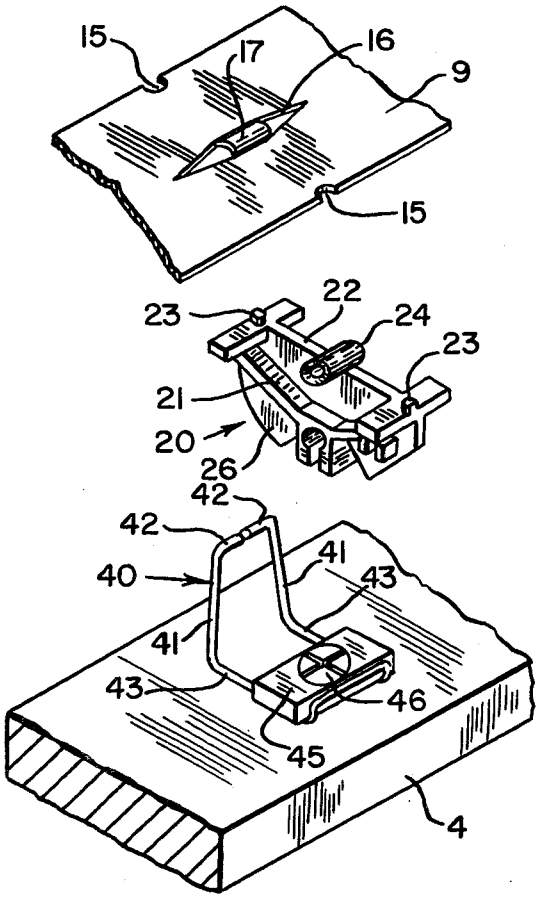
FIG. 2 is an exploded perspective view of a hanger pivot member constructed according to the invention before being mounted to a slat and to a suspension means.

Referring to FIG. 2 there is shown a hanger pivot member 20 prior to engagement with a lower end slat 9 and to a suspension means 40. The slat 9 is similar to the slats 7 except that it may have notches 15 on the edges thereof as well as a cutout 16 incl upwardly dished portion 17. The slat 9, as well as the slats 7 and the slat 8, may be curved such that it has a convex surface on its upper facing side and a concave surface on its lower facing side.

Figure 3:
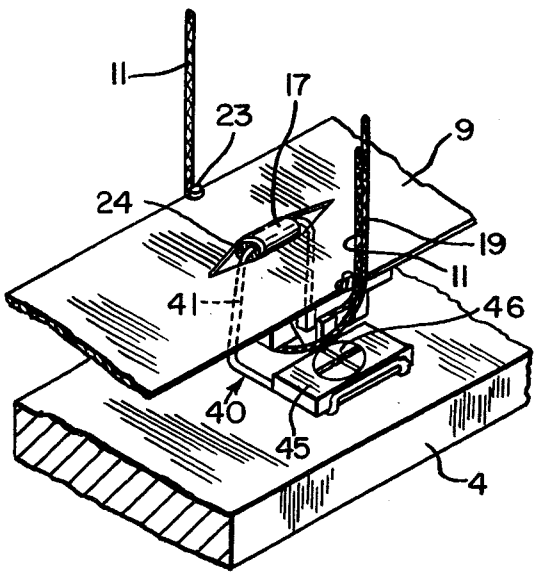
FIG. 3 is a view similar to FIG. 2 showing the hanger pivot member applied to an end slat and a suspension means.
Figure 6:
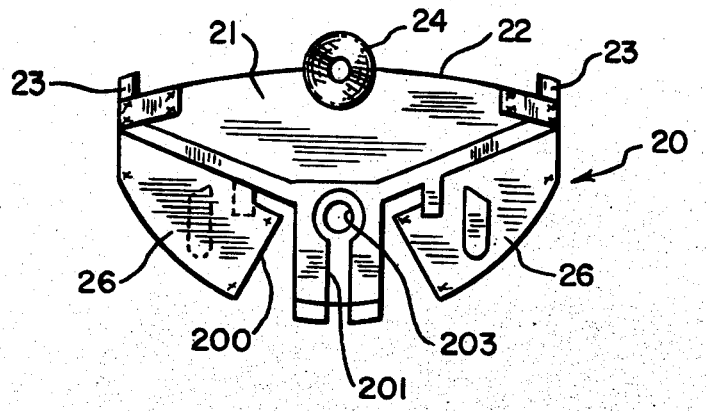
FIG. 6 is a front view of the hanger pivot member of FIG. 4.

The hanger pivot member 20 as shown in FIGS. 2 and 6 includes a body member 21 having a slat engaging surface 22 which as shown in FIG. 6 is shaped complementary to the underneath side of the slat, that is it has a convex form so as to engage with the concave underside of the slat 9 as shown in FIG. 3. The slat engaging surface 22 includes tabs 23 adapted to engage with the notches 15 on the slat 9 such that the tabs 23 serve as a coupling means for holding the hanger pivot member 20 to the slat 9 in a predetermined mutual position.

The hanger pivot member 20 further includes a pivot bearing portion 24 on the body member which as shown in FIG. 3 is adapted to extend partially through the cutout 16 in the slat such that its outer periphery rests within the dished portion 17 of the slat. When the hanger pivot member is thus positioned on the slat as shown in FIG. 3, the axis of the pivot bearing portion 24 will be substantially at the center of the slat 9 which is important to reduce forces necessary to tilt slat 9.

Figure 11:
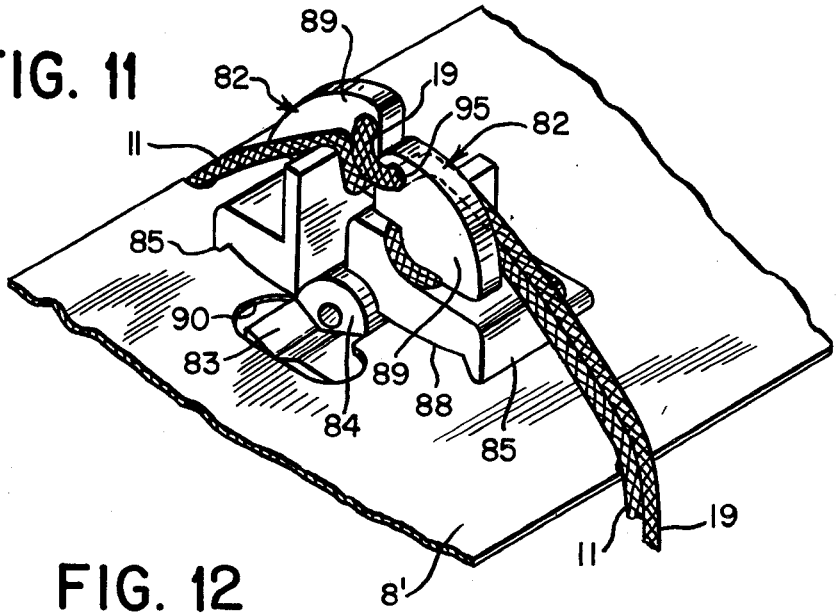
FIG. 11 is a view similar to FIG. 10 illustrating securing of a separate drive cable to the hanger pivot member FIG. 9.
Figure 12:
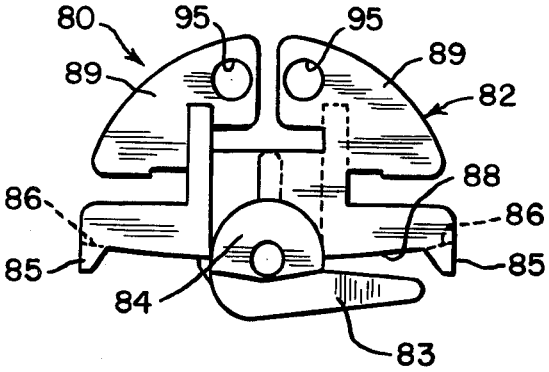
FIG. 12 is a front view of the hanger pivot member of FIG. 11.

The hanger pivot member 20 further, as shown for example in FIG. 11, has an extended portion 26 extending in a direction opposite the slat engaging surface 22 which includes a number of passages 200, slots 201 and hole 203, through which a tape cable 11 may be threaded to secure the same to the hanger pivot member, and if desired, through which a separate tilt drive cable 19 may be threaded to secure it to the hanger pivot member. The slots and passages are asymmetrically arranged with respect to the centerline of the pivot bearing portion in order that the tape cables and tilt drive cable may be substantially in line with the center of the bearing portion to reduce any tendency of its binding with the inturned ends 42 of the suspension means 40. When a separate tilt drive cable is used, it may be connected to a conventional tilt control device, not shown, such that vertical movement of the tilt drive cable will cause the hanger pivot member to be rotated about its pivot axis and consequently to move the tape cable 11 vertically to tilt the slats of the blind.

The suspension means 40 as shown in FIGS. 2 and 3 comprises a wire hanger in the form of a bracket having upstanding arms 41 including inturned ends 42 and a base 43. The bracket is fixed to the frame member 4 by means of a clamp 45 secured to the frame member by a screw 46.

The hanger pivot member 20 is fastened onto the slat 9 by pinching the edges of the slat to bend them slightly inwardly while at the same time moving the member 20 so that the slat engaging surface 22 is into contact with the concave dished portion 17 and with the tabs 23 engaging notches 15. The pressure on the slats is then released allowing the notches 15 to snap into place with the tabs 23. In this construction, the tabs 23 serve as male connection members and the notches 15 as female connection members to preposition the hanger pivot member 20 on the slat 9 while at the same time acting as a fastening means to fasten the hanger pivot member to the slat.

A tape cable is then threaded around the extended portion 26 to secure the same thereto. The arms 41 are spread apart allowing the pivot bearing portion 24 to be moved downwards so that it will be engaged by the inturned ends 42 after which the arms are allowed to spring back to secure the pivot portion to the suspension means 40 as shown in FIG. 4.

Figure 5:
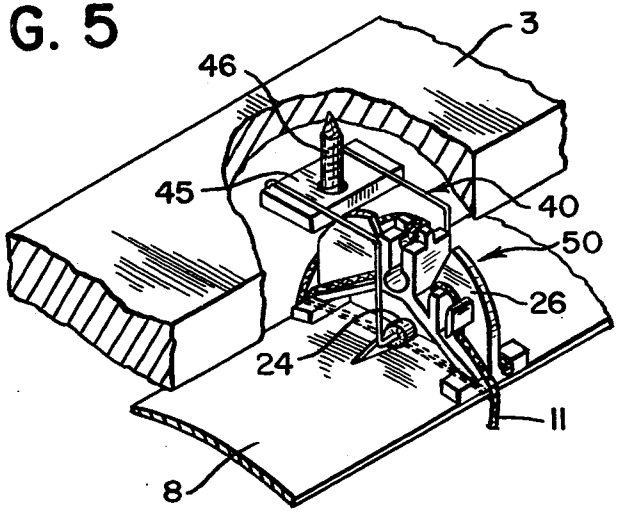
FIG. 5 is a view generally similar to FIG. 4 illustrating mounting of a suspension means to part of a frame member and the mounting of the hanger pivot member of FIG. 4 to an upper end slat and to the suspension means.
Figure 4:
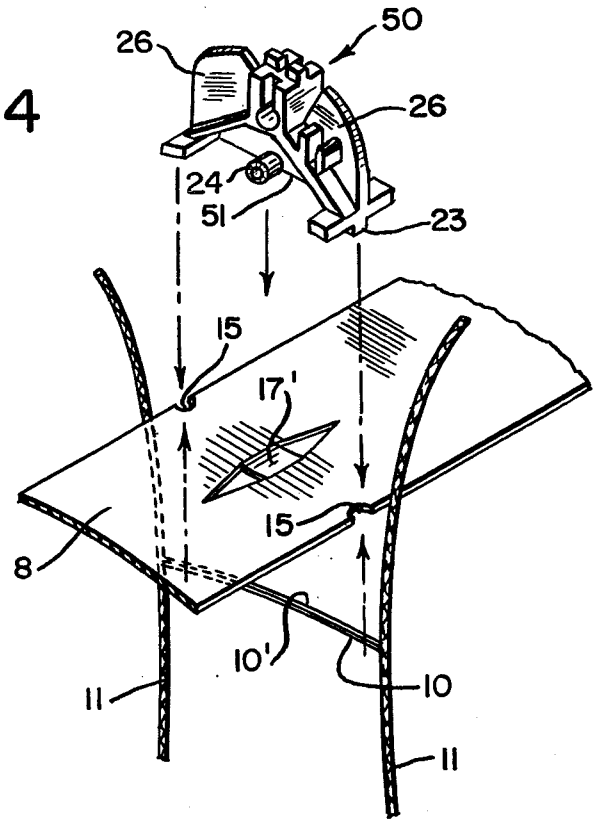
FIG. 4 is a perspective view of a hanger pivot member constructed according to the invention before application to a top end slat.
Figure 7:
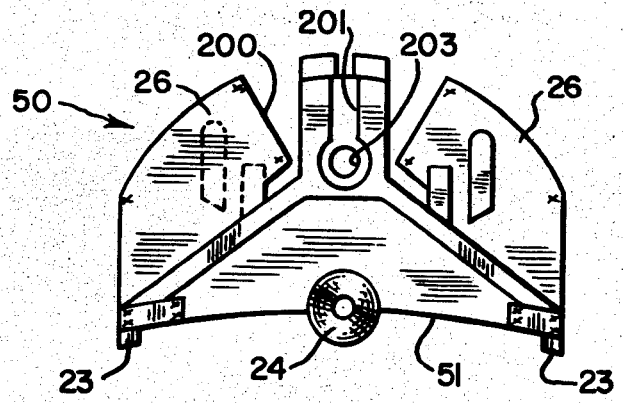
FIG. 7 is a front view of the hanger pivot member of FIG. 4

Referring to FIGS. 4 and 5 there is illustrated a hanger pivot bracket 50 prior to being applied to the upper end slat 8. The hanger pivot member 40 is similar in all respects to the hanger pivot member 20 except, as shown in FIG. 7, the slat engaging surface 51 is concave in shape rather than convex as with the hanger pivot member 20. The slat 8 is similar to the slat 9 except that the dished portion 17' is dished in an opposite direction from dished portion 17 in the slat 9. The manner of assembly of the hanger pivot member 50 with the slat 8, the threading of the tape cables to secure the same to the hanger pivot member and the attachment of the member 50 to a suspension means 40 is the same as with that of the hanger pivot member 20. As with the hanger pivot member 20, the pivot axis of the pivot bearing portion 24 extends along the centerline of the slat 8.

As shown in FIG. 1, the slat supporting means may, but not necessarily, include upper and lower rungs 10' connecting the tape cables 11 such that together they form the tape ladder 10. In this construction the upper and lower rungs are positioned on either side of the intermediate slats so as to engage a slat therebetween. However, as shown in FIG. 4, both rungs adjacent an end slat engage the surface of the slat opposite to that engaged by the slat engaging surface of the hanger pivot member. If the tape cables 11 are pulled tightly over the extended portion 26 of the hanger pivot member, then the end slat will be clamped between the rungs and the slat engaging surface of the hanger pivot member with a sufficient force to provide the coupling means necessary to hold the slat and pivot member in a predetermined mutual position. In this event, it may not be necessary to provide the interlocking between the tabs 23 and notches 15.

The venetian blind hanger pivot member and suspension means as shown in FIGS. 2–7 allows installation of a venetian blind assembly with a minimum of separate parts thus reducing inventory requirements. The slats 8 and 9 can be easily modified in the field from slats 7 to provide the notches and dished out portions thus reducing inventory requirements for slats. The hanger pivot members 20 and 50 can be readily made in a single piece by injection molding of a plastic material thus reducing hardware requirements as required in conventional assemblages to connect upper and lower slats to headrails. The suspension means in the form of wire hangers is the same for both upper and lower window frame units which eliminates the need of any headrails.

Referring to FIGS. 8–14, there is illustrated a further form of the hanger pivot member in which a single hanger pivot member has the capacity to be used with the convex sides of upper or lower end slats or, by breaking off tabs, be attached to the concave side of a lower end slat. As shown, the hanger pivot member 80 comprises a body member 81 having an extended portion 82 including holes and passages through which a tape cable 11 may be threaded as shown in FIGS. 9 and 11 to secure the same to the hanger pivot member and, if desired, through which a separate drive cable 19 may also be threaded. As shown in FIG. 8, the hanger pivot member includes a flange 83 connected to a pivot bearing portion 84 so as to extend below the pivot bearing portion. The body member 81 includes breakaway tabs 85 which form part of a slat engaging surface when the hanger pivot member is connected to the convex side of a curved slat 8' such as shown in FIGS. 8, 9 and 11.

Figure 14:
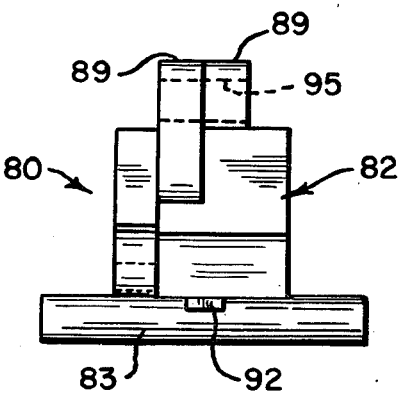
FIG. 14 an end view of the hanger pivot member of FIG. 11.

The slat 8' is generally similar in shape to the slat 8 except that it has a cutout portion 90 considerably larger than the cutout portion of slat 8 in order that flange 83 may be slipped through the cutout so that the top of the flange may engage the bottom concave surface of the slat. The cutout 90 includes a notch 91 adapted to engage with a shoulder 92 as shown in FIG. 14 which prevents the hanger pivot member from moving longitudinally with respect to the slat and to this extent acts as a coupling means to hold the hanger pivot member and slat in a predetermined mutual position. When the hanger pivot member has been mounted on the slat as shown in FIGS. 9 and 10, the slat will be tightly clamped between the upper surface of the flange, the tabs 85 and the bottom portion of the body member 81 to securely fasten the hanger pivot member to the slat.

The extended portion 82 includes slots and grooves through which a tape cable may be threaded in order to secure the tape cable to the hanger pivot member. The hanger pivot member 80 may be used with slats of varying width since it is not necessary for the hanger pivot member to connect with the sides of the slat, as is the case with the embodiment shown in FIGS. 2–7, in order for the hanger pivot member to be secured to the slat. As with the hanger pivot members of the earlier described embodiments, the pivot axis of the pivot portion 84 of the embodiment shown in FIGS. 8–14 coincides substantially with a centerline of a slat to minimize forces necessary to rotate the hanger pivot member.

It is contemplated that the hanger pivot member having the break off tabs would also be used with a bottom slat in the venetian blind assembly where the bottom slat is inverted so that the concave side of the slat faces upwardly. If for aesthetic reasons this is not desirable, then the tab portions 85 may be broken off along the dotted lines 86 as shown in FIG. 9 leaving a smooth convex slat engaging surface 88.

Figure 13:
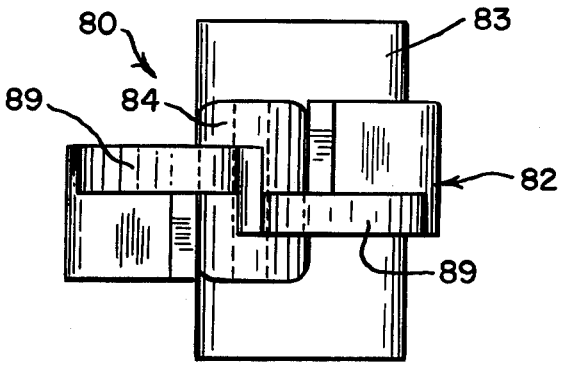
FIG. 13 a plan view of the hanger pivot member of FIG. 11.

The extended portion 82 also includes holes 95 through which a separate tilt drive cable 19 may be threaded where it is desired in those installations to have a separate tilt drive. As shown in FIGS. 11, 13 and 14, the extended portion 82 has two axially off-set tape securing portions 89 such that the separate tape drive cable 19 may contact the hanger pivot substantially along the center of the bearing portion 84 thus reducing any tendency of the bearing portion to bind on its suspension means.

Figure 15:
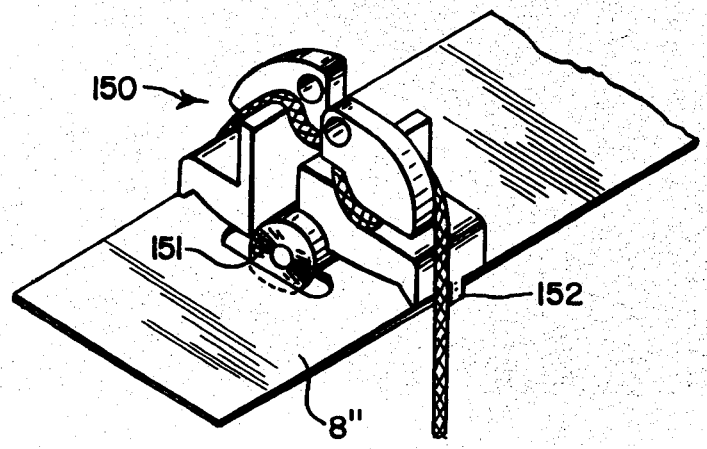
FIG. 15 is a perspective view of a further form of a hanger pivot member engaging a slat.

Referring to FIG. 15 there is illustrated a hanger pivot member 150 engaging a slat 8'' which differs from slats 8 and 8' previously described in that the slat is flat rather than curved. The hanger pivot member 150 has a pivot bearing portion 151 which extends partially through an opening in the slat such that its pivot axis is substantially at the center of slat 8''. The body member 150 includes tabs 152, only one of which is shown, which may be bent or deformed to engage the bottom surface of the slat 8'' to securely fasten the body member to the slat Instead of tabs at the ends of the body member, a portion of the bearing member could be post formed by bending or application of heat and pressure to engage the bottom surface of the slat to fasten the body member to the slat in the same general manner as with tabs 152.

While the hanger pivot members shown in FIGS. 1–15 have several forms of slots and grooves to accommodate threading of the tape cable and the tilt drive cable, it is obvious that other configurations could be used, it being important however that in all configurations the tape cable and separate tilt drive cable be substantially in line with the middle of a bearing portion in order to reduce any tendency of the bearing portion to bind.

The hanger pivot members illustrated in FIGS. 1–14 are shown fastened to curved slats. Similar hanger pivot members could be fastened to slats that are flat, such as shown in FIG. 15, or slats having complex surfaces. The only requirement is that the slat engaging surface of the hanger pivot member have a shape complementary to that of the slat, as the surfaces 22 and 51 in FIGS. 1–7, or include use of tabs such as tabs 85 of FIG. 8, which will allow the hanger pivot member to engage surfaces of various shapes.

Figure 16:
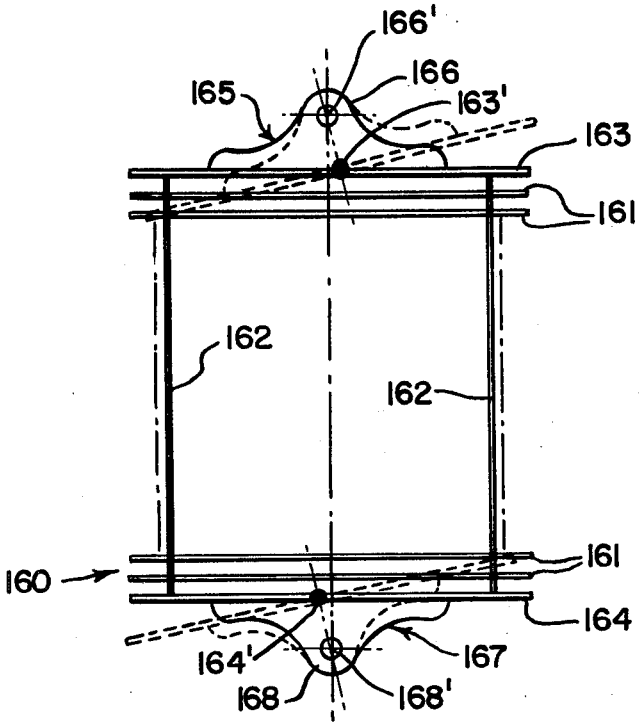
FIG. 16 is a diagrammatic view of a blind assembly constructed according to the invention having a tendency to move automatically to a slats open position.

Blind assemblies utilizing hanger pivot members as previously described may be constructed to have a tendency upon removal of a tilting force to return to a slats open or slats closed position. Referring to FIG. 16, a blind assembly 160 is illustrated having a plurality of intermediate slats 161 supported by tape cables 162 extending between an upper end slat 163 and a lower end slat 164. A hanger pivot member 165 having a pivot bearing portion 166 is fastened to slat 163 such that the pivot axis 166' is above the center of the slat while the lower end slat 164 has a hanger pivot member 167 fastened thereto and which includes a pivot bearing portion 168 with a pivot axis 168' being positioned below the center of the lower slat. Application of a tilting force to close the blinds results in stretching of the cables thus placing them under tension. This is because the center 163' of the end slat 163 and the center 164' of the end slat 164 move away from each other thus increasing tension in cables 162. Removal of the force allows the cables to contract thus tending to open the blinds.

Figure 17:
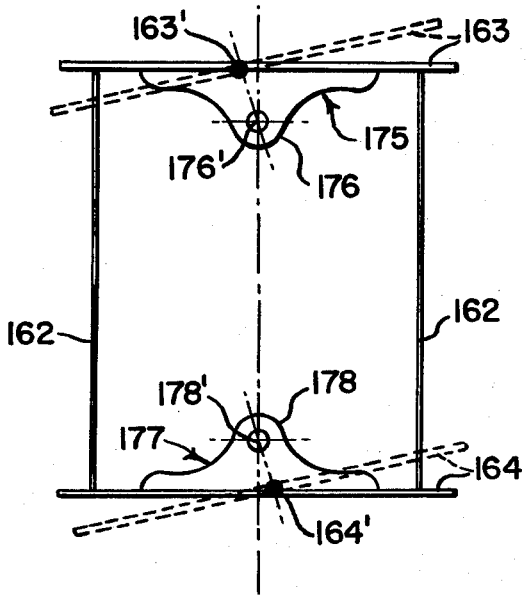
FIG. 17 is a diagrammatic view of a blind assembly constructed according to the invention having a tendency to move automatically to a slats closed position.

In order to obtain a blind assembly having a tendency to return slats to a closed position, the hanger pivot members are reversed as compared to the arrangement in FIG. 16. As shown in FIG. 17, a hanger pivot member 177 having a bearing portion 178 is fastened to the upper side of the lower end slat 164 so that the pivot axis 178' is positioned above the center of slat 164. An opposite hanger pivot member 175 having a bearing portion 176 is fastened to the bottom side of the top end slat 163 such that the pivot axis 176' is positioned below the top end slat 163. Application of a tilting force to open the slats will result in stretching of the cables 162 thus placing them under tension. This is because the centers 163' and 164' of the end slats move towards each other thus decreasing tension in cables 162. Removal of the tilting force will allow the cables to contract thus tending to return the slats to a closed position.

Figure 18:
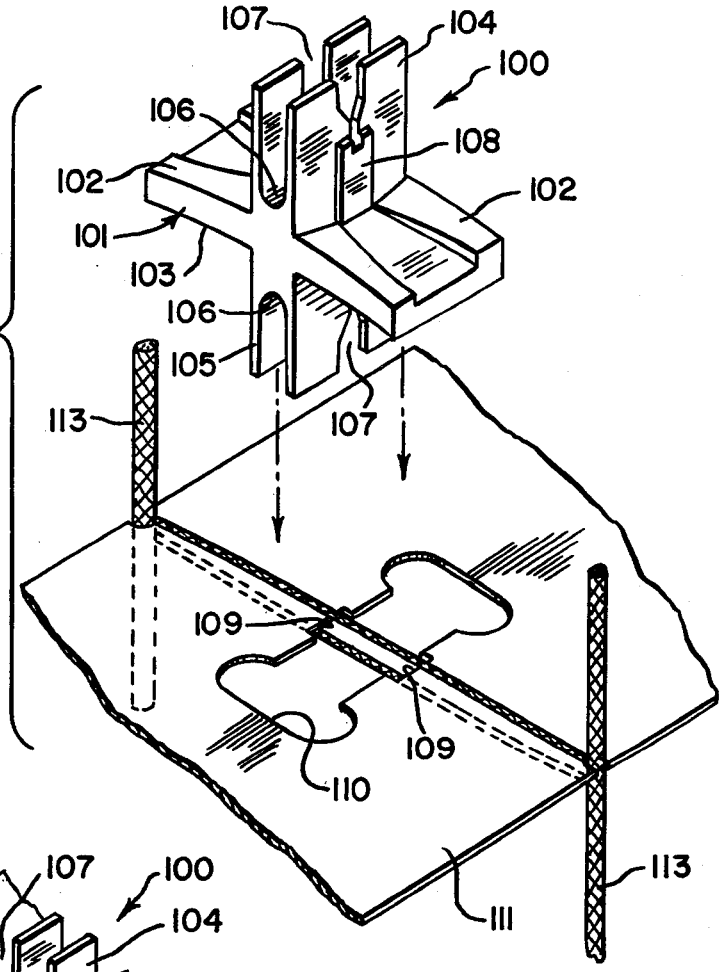
FIG. 18 is an exploded perspective view of a still further hanger pivot member constructed according to the invention before application to a top end slat.
Figure 19:
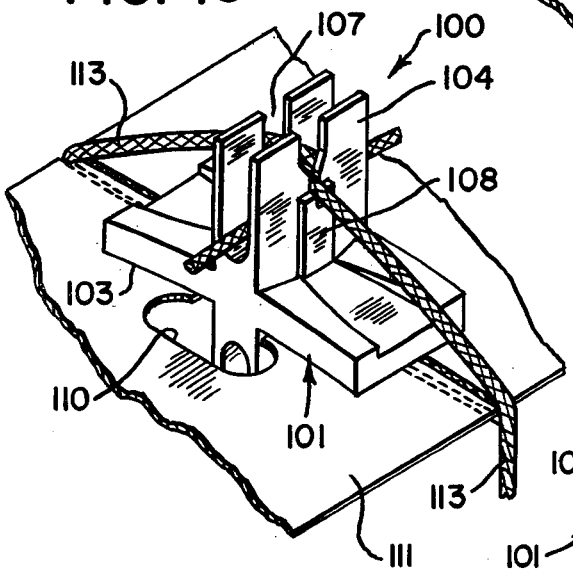
FIG. 19 is a view similar to FIG. 18 showing the hanger applied to an end slat.
Figure 20:
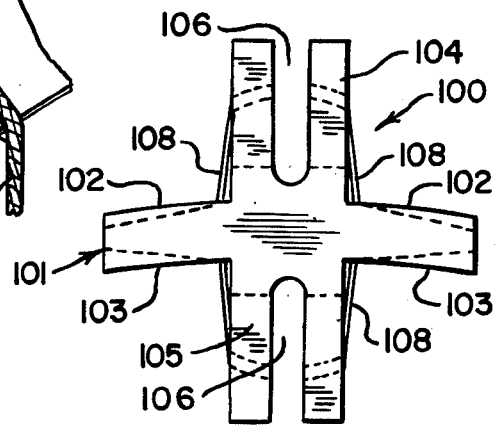
FIG. 20 is an enlarged front side view of the hanger pivot member of FIGS. 18 and 19.

Referring to FIGS. 18–20, there is illustrated a still further form of hanger pivot member 100 having a horizontally extending bar 101 including a convexly curved upper surface 102 and a concavely curved lower surface 103. The member 100 also includes an upper vertical leg 104 and an identical lower vertical leg 105 each having a longitudinally extending slot 106 and a laterally extending slot 107. A tab 108 forming a male coupling member is included on both sides of the upper and lower legs and is adapted to engage with a notch 109 forming a female coupling member contained in a cutout 110 of a top slat 111. As shown in FIG. 20 end slat 111 has a convex upper surface which as shown in FIG. 19 engages with the concave surface 107 of the member 100.

The manner of assembly of the slat 111 and member 100 is as follows. The slat 111 is initially positioned between upper and lower rungs which extend beween tape cables 113. The member 100 is lowered onto the slat so that both rungs are engaged in the laterally extending slot 107 of the lower leg 105. The member 100 is then pushed into the cutout 110 until the sides thereof fit into engagement with the sides of the lower leg. The cables 113 are then threaded into the slots 106 and 107 of the upper leg to secure the same thereto. If desired, the sides of the slots may then be swaged to securely lock the cables in the slots. The hanger pivot member may then be mounted on a suspension means of the type shown in FIG. 2 so that the inturned ends of the suspension means engage in slot 106 of the lower leg.

While the blind assemblies have been described for convenience as having top and bottom end slats, the assemblies could be reversed from top to bottom, i.e. turned upside down and still perform the function for which they are designed. In addition to complete reversal, the blind assemblies could be partially rotated in a vertical plane such that the slats are inclined or vertical and the assemblies would still open and close in the manner described previously.

I claim:

1. A venetian blind hanger pivot member for a venetian blind assembly having a plurality of substantially identical slats including upper and lower end slats and tape cables forming part of a slat supporting means, characterized in that said hanger pivot member includes a body member having a slat engaging surface adapted to engage one side of an end slat, coupling means for holding said hanger pivot member and said end slat in a predetermined mutual position, a pivot bearing portion on said body member adapted to be pivotally engaged by a suspension bracket attached to a part of a frame opening, and tape cable securing means on said body member adapted to secure a tape cable to the body member whereby the tape cable may extend from said tape cable securing means over a side edge of an end slat.

2. A venetian blind hanger pivot member according to claim 1 further characterized in that said pivot member is adapted to extend partially through an end slat whereby a pivot axis of the bearing portion is at the center of a slat.

3. A venetian blind hanger pivot member according to claim 1 further characterized in that said body member has an extended portion extending away from said slat engaging surface with said extended portion including said tape cable securing means spaced from said slat engaging surface.

4. A venetian blind hanger pivot member according to claim 3 further characterized in that said extended portion has thereon a separate tilt drive cable securing means adapted to secure a tilt drive cable to said pivot hanger member with said tilt drive cable being adapted to tilt said hanger pivot about a suspension means.

5. A venetian blind hanger pivot member according to claim 1 further characterized in that said coupling means includes tabs depending from said slat engaging surface adapted to engage an opening in an end slat or a notch on each side edge of an end slat.

6. A venetian blind hanger pivot member according to claim 1 further characterized in that said slat engaging surface is shaped complementary to the surface of said end slat with which it is adapted to engage.

7. A venetian blind hanger pivot member according to claim 6 further characterized in that said slat engaging surface is curved in shape to engage a curved surface of an end slat.

8. A venetian blind hanger pivot member according to claim 1 further characterized in that said pivot bearing portion extends outwardly from said end slat engaging surface to engage a dished portion of an end slat complementary in shape to said pivot bearing portion.

9. A venetian blind hanger pivot member according to claim 1 further characterized in that said coupling means comprises a flange connected to said pivot bearing portion and adapted to engage the opposite side of an end slat than said slat engaging surface.

10. A venetian blind hanger pivot member according to claim 9 further characterized in that said slat engaging surface includes a breakoff tab at each end of said body member adapted to engage a convex side of an end slat.

11. A venetian blind hanger pivot member according to claim 1 further characterized in that said coupling means includes fastening means to fixedly connect the pivot member to an end slat.

12. A venetian blind hanger pivot member according to claim 11 further characterized in that said fastening means comprises a portion of the pivot member adapted to tightly engage and clamp with a side of an end slat opposite the side of said slat engaged by said slat engaging surface.

13. A venetian blind hanger pivot member according to claim 1 further characterized in that said member is in the general form of a cross having a horizontally extending bar and upper and lower vertically extending legs with the upper and lower surfaces of said bar each forming a slat engaging surface.

14. A venetian blind hanger pivot member according to claim 13 further characterized in that each said leg has a longitudinally extending slot and a laterally extending slot with said longitudinally extending slot adapted to receive said suspension bracket and said laterally extending slots adapted to receive a tape cable to provide a part of said tape cable receiving means.

15. A venetian blind assembly comprising a plurality of slats substantially identical in shape and size including an upper end slat and a lower end slat, a hanger pivot member connected to each of said upper end and lower end slats and having a slat engaging surface, each said hanger member including a pivot bearing portion, slat supporting means including tape cables secured to each hanger pivot member and extending between said upper end slat and said lower end slat, and suspension means pivotally mounting the hanger pivot members to parts of a frame opening whereby pivotal movement of a hanger pivot member with respect to said suspension means will cause all of said slats to tilt.

16. A venetian blind assembly comprising a plurality of slats including an upper end slat and a lower end slat, a hanger pivot member connected to each of said upper end and lower end slats and having a slat engaging surface with each said hanger pivot member including a pivot bearing portion, a tape ladder including cross rungs and tape cables secured to each hanger pivot member and extending between said upper end slat and said lower end slats, said tape cables being secured to at least said hanger pivot member engaging said upper end slat with said tape cables extending over said upper end slat and the hanger pivot member engaged thereto and a cross rung extending beneath said upper end slat and the hanger pivot member engaged thereto to clamp said upper end slat to said hanger pivot member.

17. A venetian blind assembly according to claim 16 wherein said hanger pivot member has at least one male connection member engaging with a female connection member on an end slat to hold said upper end slat and hanger pivot member in a mutually predetermined position.

18. A venetian blind assembly according to claim 16 wherein said hanger pivot member is adhered to said upper end slat by an adhesive to hold said upper end slat and hanger pivot member in a mutually predetermined position.

19. A venetian blind hanger pivot member according to claim 13 further characterized in that said upper and lower surfaces of said bar conform to the surface of said end slat with which it is adapted to engage.

* * * * *

UNITED STATES PATENT AND TRADEMARK OFFICE

CERTIFICATE OF CORRECTION

PATENT NO. : 4,458,740

DATED : July 10, 1984

INVENTOR(S) : Richard N. Anderson

It is certified that error appears in the above-identified patent and that said Letters Patent is hereby corrected as shown below:

Col. 4, line 32, "Fig. 4" should read --Fig. 2--;
Col. 4, lines 45-46, "pivot member Fig. 9" should read --pivot member of Fig. 9--;
Col. 4, line 49, "Fig. 13 a plan" should read --Fig. 13 is a plan--;
Col. 4, line 52, "Fig. 14 an" should read --Fig. 14 is an--;
Col. 5, line 19, "incl upwardly" should read --including an upwardly--;
Col. 6, line 4, "is into contact" should read --is brought into contact--;

Signed and Sealed this

*Eighteenth* Day of *December 1984*

[SEAL]

*Attest:*

*Attesting Officer*

GERALD J. MOSSINGHOFF

*Commissioner of Patents and Trademarks*